United States Patent [19]

Crumley

[11] Patent Number: 4,718,524

[45] Date of Patent: Jan. 12, 1988

[54] ORGANIZER FOR PERSONAL SUNDRY ITEMS

[76] Inventor: Anita B. Crumley, 10108 Canton Center, Plymouth, Mich. 48170

[21] Appl. No.: 33,726

[22] Filed: Apr. 3, 1987

[51] Int. Cl.[4] ..... B65D 30/22

[52] U.S. Cl. ..... 190/110; 150/113; 383/39

[58] Field of Search ..... 383/38–40; 150/112, 113, 52 C; 190/108, 109, 110, 1, 11, 901; 206/45.17, 45.18

[56] References Cited

U.S. PATENT DOCUMENTS

| | | | |
|---|---|---|---|
| 754,227 | 3/1904 | Moog | 190/16 |
| 1,329,429 | 2/1920 | Perry | 190/11 |
| 1,705,149 | 3/1929 | Brady | 190/901 X |
| 2,405,517 | 8/1946 | Plummer | 383/39 X |
| 2,493,182 | 1/1950 | Beder | 190/901 X |
| 2,631,632 | 3/1953 | Leachman | 190/901 X |
| 3,086,572 | 4/1963 | Lubin | 383/39 X |
| 3,403,716 | 10/1968 | Siris | 150/112 |
| 3,833,098 | 9/1974 | Alderman | 190/1 X |
| 3,967,666 | 7/1976 | Farrar | 383/39 X |

FOREIGN PATENT DOCUMENTS

| | | | |
|---|---|---|---|
| 598671 | 12/1925 | France | 190/109 |
| 2377170 | 9/1978 | France | 206/45.18 |
| 50133 | 10/1909 | Switzerland | 206/45.18 |
| 280044 | 4/1952 | Switzerland | 150/112 |

*Primary Examiner*—William Price

*Attorney, Agent, or Firm*—Charles W. Chandler

[57] ABSTRACT

A bag has an opening for receiving a foldable insert comprising a pair of hingedly connected panels, each having several pockets on opposite sides thereof. The panels are moveable between a fully open position in which they are disposed in a common plane, a fully closed position in which they are disposed adjacent one another for storage, and a partially open position in which they are adapted to be self-supporting on the edges of the two panels.

3 Claims, 5 Drawing Figures

ORGANIZER FOR PERSONAL SUNDRY ITEMS

BACKGROUND OF THE INVENTION

This invention is related to carrying cases for sundry personal devices for travelers, and more particularly to a collapsible organizer which can be readily folded and inserted, with its contents, into a tote bag, and when removed from the tote bag either opened and laid flat for use, or partially folded, to stand on its edges in an upright position.

Travelers frequently carry a variety of miscellaneous toiletries such as curling irons, hair dryers, brushes, combs, shampoo, hair spray, toothbrush, soaps and deodorants, lotions, colognes, razors, medicines and the like. A problem arises in packing such items for travel and when reaching a destination, unpacking them in such a manner that they are readily accessible to the user but still easy to repack. Usually such items are stored in some sort of a bag or suit case, where they are unorganized and difficult for access.

Some organizers of the prior art are illustrated in U.S. Pat. No. 3,086,572 which issued to Bertha Lubin on Apr. 23, 1963; and U.S. Pat. No. 3,403,716 which issued Oct. 1, 1968 to Irwin Herbert Siris.

SUMMARY OF THE INVENTION

The broad purpose of the present invention is to provide a traveler's organizer comprising a pair of rectangular panels hinged such that they are self supporting when mounted along their open edges in an upright position. Each panel has pockets of various sizes on both sides of the panel. A strap is connected along the hinge of the organizer so that it can be either carried or pulled out of the tote bag in which it is carried. The lower edges of the two panels are connected together by a pair of straps having Velcro fasteners so that the organizer can be supported in an upright position.

The organizer can be made in a variety of sizes depending upon the user's requirements.

Still further objects and advantages of the invention will readily become apparent to those skilled in the art to which the invention pertains upon reference to the following detailed description.

DESCRIPTION OF THE DRAWINGS

The description refers to the accompany drawings in which like reference characters refer to like parts throughout the several views, and in which.

THE DESCRIPTION OF THE PREFERRED EMBODIMENT

Figure 1:
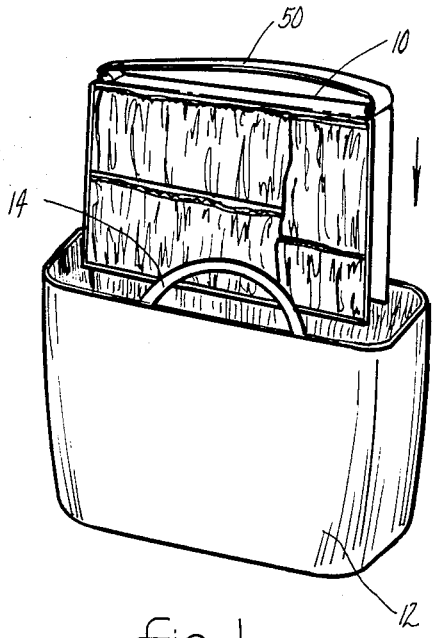
FIG. 1 illustrates a preferred organizer in its fully closed position being inserted into a tote bag.

Referring to the drawings, FIG. 1 illustrates an organizer 10 being inserted in tote bag 12 having handle means 14. The tote bag may also be any suitable traveling luggage having sufficient interior space for receiving the organizer. Organizer 10 may be made in any of a variety of sizes depending upon the number of items being carried.

Organizer 10 comprises a pair of rectangular panels 16 and 18 having lower edges 20 and 22, respectively. A book binding hinge 24 connects the upper edges of the two panels such that they can be folded toward one another along fold lines 26 and 28. The panels can be folded toward a fully collapsed position illustrated in FIG. 1 for traveling, a partially open position, illustrated in FIGS. 2 and 3, and a fully opened position illustrated in FIGS. 4 and 5.

Both sides of the two panels are at least partially covered with a nylon acetate, a mildew and water resistant material, to form pockets of various sizes such as pockets 30, 32 and 34 on one side of panel 18, and a long pocket 36 on the opposite side of panel 18; elongated pocket 38 on one side of panel 16 and three pockets 40, 42 and 44 on the opposite side of panel 16. The size of the various pockets are chosen to accommodate various items carried by the user.

Figure 5:
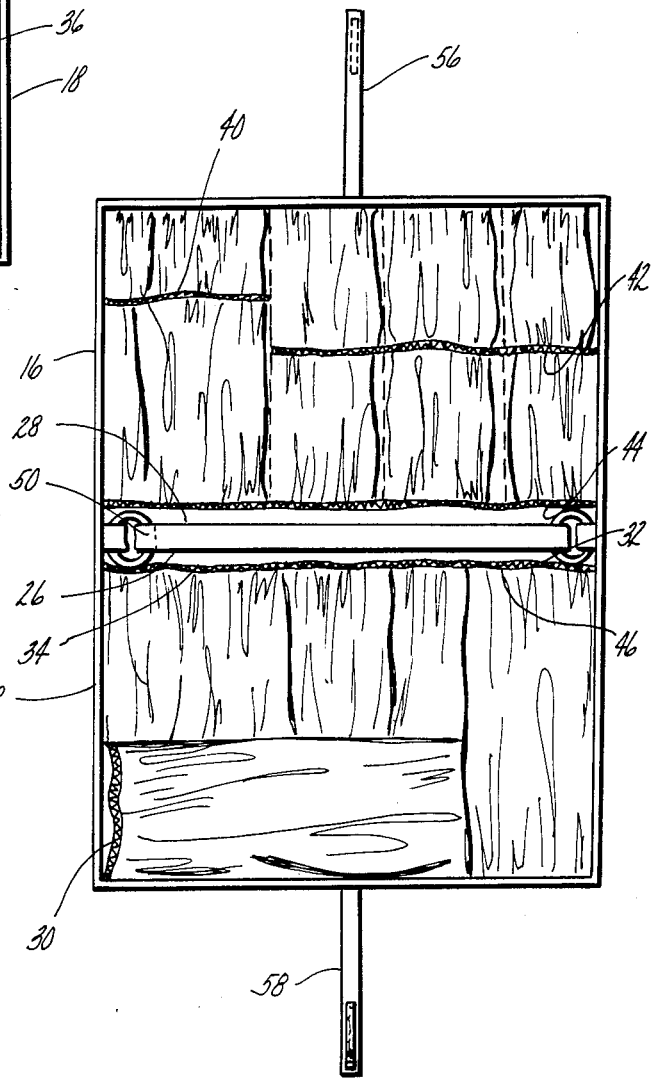
FIG. 5 illustrates the opposite side of the organizer in its fully open position.

Preferably, each pocket has an elasticized opening such as at 46, illustrated in FIG. 5. The pockets may accommodate sample size products, not shown, which are readily available at stores. The appliances can include a curling iron, hair dryer, electric razor and the like (not shown), depending upon the user's personal requirements.

An elongated strap 50 having its ends connected by rings 52 and 54 are attached to opposite ends of hinge 24 to assist the user in removing the organizer from the tote bag.

Figure 2:
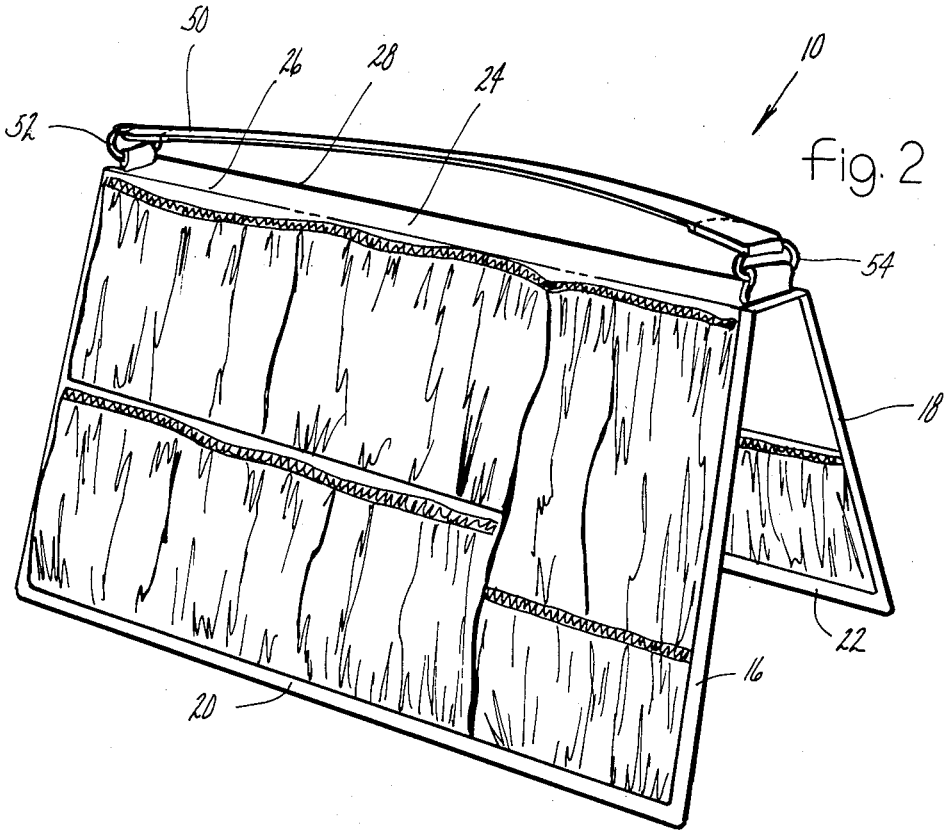
FIG. 2 is a perspective view illustrating the organizer removed from the tote bag and supported in an upright position.

A strap 56 has one end attached to the lower edge 22 of panel 16, and a second strap 58 is attached to the lower edge 20 of panel 18. The opposite ends of the two straps have complementary strips of hook and fastener means 60 and 62 so that the free ends of the two straps can be connected together, as illustrated in FIG. 2, to limit the spread of the two panels when the organizer is being supported in its upright position.

Figure 3:
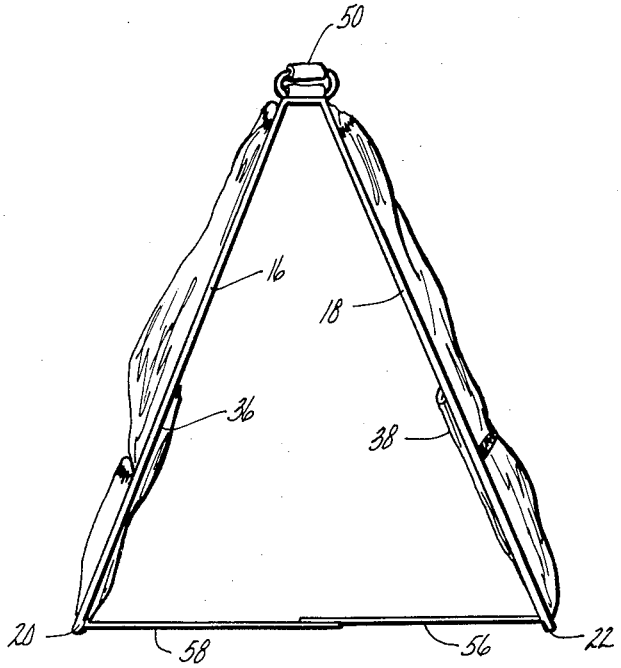
FIG. 3 is a view seen from one end of FIG. 2.
Figure 4:
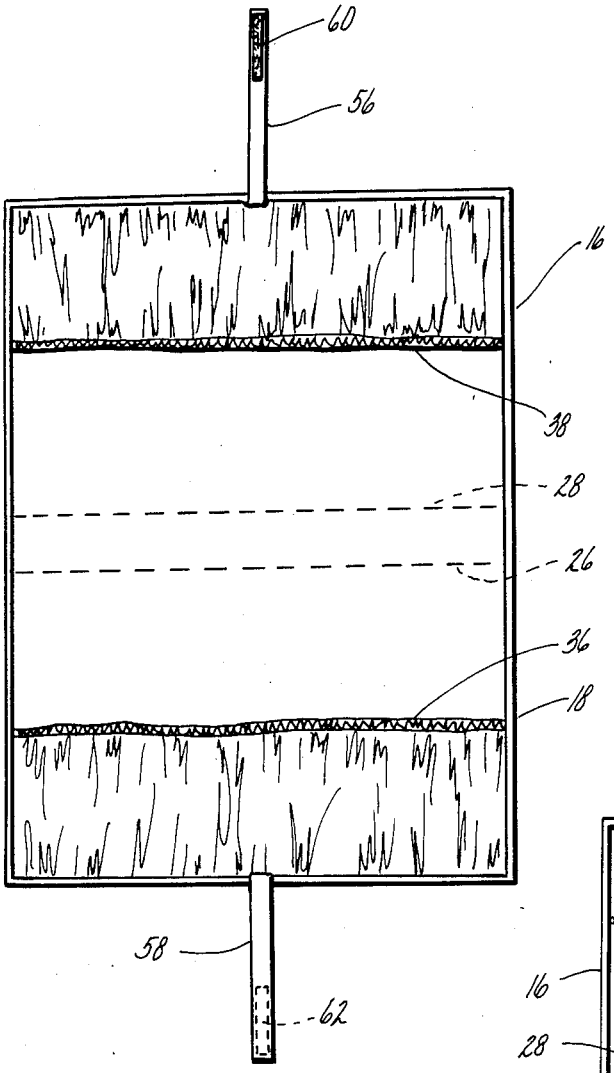
FIG. 4 illustrates one side of the organizer in its fully open position.

In the position illustrated in FIG. 3, the interior pockets 36 and 38 on the inside of the two panels are accessible for removal of an appliance or the like while the outside pockets are also accessible. In this arrangement, all the products and appliances are readily and individually accessible. Those products, not used, remain in the pocket. When the user is ready to repack, he need to only to insert the products or appliances that have been used into their respective pockets, raise the organizer by handle 50 so that the two panels collapse back to back, and then insert the organizer into a tote bag or suitable traveling bag, as illustrated in FIG. 1. These features eliminate the need for the user to completely unpack. He need only use what he requires and then return the item to its pocket.

The preferred embodiment of the invention is especially useful not only for people who travel but individuals who work out in a spa or for weekend campers. It eliminates the problems of a busy traveler having to think about packing and unpacking their bathroom. He is ready to travel in a mements notice.

Having described my invention, I claim:

1. An organizer, comprising:

first and second similarly shaped panels having inner edges pivotally connected about a hinge section having a pair of spaced fold lines such that the first and second panels are foldable between a first position in which the first panel is disposed adjacent to and substantially parallel to the second panel, a fully open position in which the first panel and the second panel are disposed in a common plane, and a partially folded position in which the first panel is disposed at an angle with respect to the second panel so as to be self-supporting when the outer edges of the two panels are disposed on a supporting surface;

strap means connected between the outer edges of first and second panels to prevent spreading thereof in said partially folded position; and first pocket means disposed on opposite sides of the first panel, and second pocket means disposed on opposite sides of the second panel.

2. A combination as defined in claim 1, including a second elongated strap having its ends connected to the hinge section for carrying the first and second panels in said folded position.

3. A combination as defined in claim 1, including a bag having an opening for receiving the panels in said fully open position to a stored position in said bag.

* * * * *